US005899596A

United States Patent [19]

Thompson

[11] Patent Number: 5,899,596

[45] Date of Patent: May 4, 1999

[54] OPTIMIZATION OF ELECTROPHOTOGRAPHIC EDGE DEVELOPMENT

[75] Inventor: John A. Thompson, Boise, Id.

[73] Assignee: Hewlett-Packard Company, Palo Alto, Calif.

[21] Appl. No.: 09/087,430

[22] Filed: May 29, 1998

[51] Int. Cl.[6] ..... G03G 15/08

[52] U.S. Cl. ..... 399/55; 399/46; 399/50

[58] Field of Search ..... 399/55, 46, 29, 399/49, 50, 51, 53, 9, 30, 31, 138, 314

[56] References Cited

U.S. PATENT DOCUMENTS

| | | | |
|---|---|---|---|
| 4,632,537 | 12/1986 | Imai | 399/9 |
| 4,647,184 | 3/1987 | Russel et al. | 399/9 |
| 5,132,738 | 7/1992 | Nakamura et al. | 399/314 |
| 5,287,149 | 2/1994 | Hoshika | 399/138 |
| 5,815,768 | 9/1998 | Clifton | 399/49 X |
| 5,832,333 | 11/1998 | Umeda et al. | 399/50 X |
| 5,839,020 | 11/1998 | Rushing et al. | 399/49 |

FOREIGN PATENT DOCUMENTS

| | | |
|---|---|---|
| 1-285966 | 11/1989 | Japan . |
| 6-250436 | 9/1994 | Japan . |
| 8-83021 | 3/1996 | Japan . |

*Primary Examiner*—Arthur T. Grimley
*Attorney, Agent, or Firm*—Gregg W. Wisdom

[57] ABSTRACT

The development of the edges of discharged areas on a photoconductor drum in an electrophotographic printing system is controlled by the ratio of the DC component of the developer bias to the magnitude of the difference between the DC component of the developer bias and the DC component of the bias supplied to the photoconductor charge roller. A development system using a developer, a photoconductor charge roller, a high voltage power supply, an optical density sensor, and a controller for controlling the high voltage power supply optimizes the electrophotographic edge development. The optical density sensor is used in a calibration process to determine the value of the DC component of the developer bias necessary to ensure the optical density of developed areas will meet the minimum specified optical density. Optimization of the edge development is accomplished by controlling the high voltage power supply so that the difference between the DC component of developer bias and the DC component of the photoconductor bias is maintained at a substantially constant value as the DC component of the developer bias is adjusted on successive calibrations.

14 Claims, 7 Drawing Sheets

OPTIMIZATION OF ELECTROPHOTOGRAPHIC EDGE DEVELOPMENT

FIELD OF THE INVENTION

This invention relates to the electrophotographic production of images. More particularly, this invention relates to the control of bias levels used in an electrophotographic printing system to achieve an improvement in print quality.

BACKGROUND OF THE INVENTION

An initial step in the electrophotographic printing process includes the deposition of a charge onto the surface of the photoconductor. Additionally, the photoconductor is discharged by selectively exposing the surface of the photoconductor to a scanning laser beam to form a latent electrostatic image. After formation of the latent electrostatic image, toner is developed onto the surface of the photoconductor drum during development.

One type of commonly used technique for the development of toner onto the latent electrostatic on the surface of the photoconductor is jump gap development. In the jump gap development process, an electrical signal is applied to a developer roller located close to the surface of the photoconductor. The gap between the surface of the photoconductor and the sleeve of the developer roller is usually in the range of several hundred microns. The electrical signal typically includes a DC component of the developer bias having a superimposed sinusoidal or square wave AC signal.

The charge on the surface of the photoconductor and the electrical signal applied to the developer roller create an electric field which moves electrically charged toner particles across the gap and onto the surface of the photoconductor. The combination of the AC and DC components of the electrical signal applied to the developer roller provides the electric field that strips toner off the sleeve of the developer roller and helps remove toner from the areas on the surface of the photoconductor which are not part of the latent electrostatic image.

The jump gap development process works well for the development of the interior portions of discharged areas on the surface of the photoconductor. However, in some cases, the jump gap development process does not fully develop the edges of the discharged areas. This can contribute to a degradation in the perceived quality of the printed image because the lack of development of edge detail. Furthermore, color printing is particularly susceptible to print quality problems resulting from jump gap development. Because high quality color printing requires, not only the capability to develop the fine features of images, but also the capability to precisely control the developed amounts of the various colored toners to accurately reproduce the desired colors, the shortcomings of the jump gap development process can be especially noticeable in color printing. Improving the performance of the jump gap development process provides a way in which the demands for improved print quality in electrophotographic printing can be met.

SUMMARY OF THE INVENTION

Accordingly, a development system, for developing toner onto a photoconductor, achieves an improvement in the jump gap development process through the control of elements in the development system. The development system includes a developer and a photoconductor charging device. The development system further includes a power supply coupled to the developer and the photoconductor charging device. The power supply is used for supplying a first DC bias to the developer and supplying a second DC bias to the photoconductor charging device. The power supply maintains the difference in the magnitude of the first DC bias and the second DC bias substantially constant with changes in the first DC bias. By controlling the first DC bias and the second DC bias in this fashion, the consistency of edge development of discharged areas is improved.

An electrophotographic printing system for improving edge development includes a photoconductor, a photoconductor charging device to charge the photoconductor, and a developer to develop toner onto the photoconductor. The electrophotographic printing system further includes a power supply coupled to the developer and the photoconductor charging device. The power supply is used for supplying a first DC bias to the developer and supplying a second DC bias to the photoconductor charging device. The power supply is used for supplying a first DC bias to the developer and supplying a second DC bias to the photoconductor charging device. The power supply maintains the difference in the magnitude of the first DC bias and the second DC bias substantially constant with changes in the first DC bias.

An electrophotographic printing system includes a photoconductor, photoconductor charging device to charge the photoconductor, and a developer to develop toner onto the photoconductor. The electrophotographic printing system further includes a power supply to provide a first DC bias to the developer and a second DC bias to the photoconductor charging device, and a controller to control the first DC bias and the second DC bias. The electrophotographic printing system is used in a method for controlling the development of toner onto the photoconductor that includes the steps of setting the first DC bias at a first value, setting the second DC bias at a second value, and maintaining the difference in the magnitude of the first DC bias and the second DC bias substantially equal to a first predetermined value with subsequent changes in the first DC bias. By controlling the first DC bias and the second DC bias in this fashion, the consistency of edge development of discharged areas is improved.

DESCRIPTION OF THE DRAWINGS

A more thorough understanding of the invention may be had from the consideration of the following detailed description taken in conjunction with the accompanying drawings in which.

DETAILED DESCRIPTION OF THE DRAWINGS

The present invention is not limited to the specific exemplary embodiments illustrated herein. Although the embodiments of the toner development system will be discussed in the context of a color electrophotographic printer, it should be recognized that the toner development system has applicability to any electrophotographic printing system employing a jump gap development system.

Figure 1:
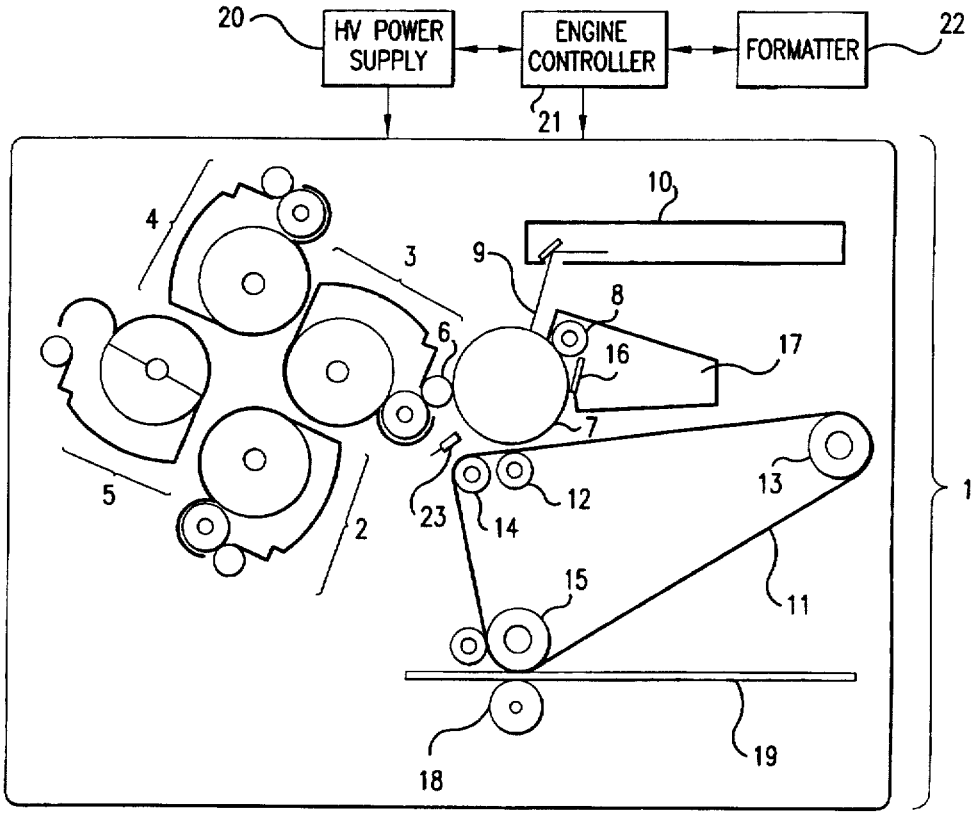
FIG. 1 shows a simplified schematic representation of a color electrophotographic printing system including the preferred embodiment of the development system.

Shown in FIG. 1 is a simplified schematic representation of a color electrophotographic printing system 1 containing the preferred embodiment of the development system. The exemplary electrophotographic printing system 1 uses three colored toners, cyan, magenta, and yellow and a black toner for accomplishing color printing. The cyan developer 2, magenta developer 3, yellow developer 4, and black developer 5 are mounted on a developer carousel (not shown in FIG. 1) which rotates the developer from which toner will be taken to the appropriate position. The function of the developer carousel is indicated by the relative positions of the cyan 2, magenta 3, yellow 4, and black 5 developers.

The advantages provided by the development system include the repeatable development of solid areas and detail areas over the range of environmental conditions experienced by the electrophotographic printing system 1 and over the range of system component performance resulting from wear. Additionally, use of the development system will reduce the severity of edge development artifacts. One type of edge development artifact that can occur is known as "white gap". In this particular edge development artifact, the edges of an area do not fully develop thereby resulting in a white gap circumscribing the developed area. For example, in the case of text overlaying an image, a very noticeable white gap occurs around the edges of the text character. Use of the development system significantly reduces the degree to which this white gap occurs.

The electrophotographic printing system 1 forms the printed image by successively printing each of the four color planes. For the purposes of illustrating the operation of electrophotographic printing system 1, first consider the printing of the magenta color plane. In this case, the developer carousel will have rotated the magenta developer 3 into position so that the magenta developer 3 is positioned opposite photoconductor drum 7. The developer carousel is located so that when the developers 2–5 are rotated into position, a tightly controlled first gap exists between the surface of developer roller 6 (or any of the other developer rollers so located) and the surface of photoconductor drum 7. This first gap is optimized for the movement of toner across it in response to an applied electric field.

A charging device, such as photoconductor charge roller 8, deposits a negative charge on the surface of photoconductor drum 7. A laser beam 9 emitted by laser scanner 10 is pulsed as it is swept across the surface of the photoconductor drum 7. Laser scanner 10 typically uses a rotating multifaceted rotating mirror to sweep laser beam 9 across the surface of photoconductor drum 7. The pulsing of laser beam 9 is controlled so that the areas of the photoconductor drum 7 onto which magenta toner will be developed are discharged by laser beam 9 as the photoconductor drum 7 rotates in the counter-clockwise direction. The discharged areas on the surface of photoconductor drum 7 rotate so that they are located opposite the surface of developer roller 6. As the discharged areas on the surface of photoconductor drum 7 most closely approach the surface of developer roller 6, magenta toner located on the surface of developer roller 6 is projected onto the discharged areas of photoconductor drum 7.

Each of the toners acquires a negative charge through tribo-electric charging which occurs within the toner reservoirs of the cyan 2, magenta 3, yellow 4, and black 5 developers. An electrical signal applied to developer roller 6 creates an electric field which provides the force to project magenta toner from the surface of developer roller 6 onto discharged areas of photoconductor drum 7. The electrical signal applied to developer roller 6 includes a negative DC component of the developer bias with a superimposed AC voltage.

Electrophotographic printing system 1 uses a toner carrying member, such as transfer belt 11, to collect the toner from each developed color plane. The location around the circumference of photoconductor drum 7 which most closely approaches the surface of transfer belt 11 facing photoconductor drum 7 defines a second gap. The surface of the photoconductor drum 7, now electrostatically holding magenta toner developed onto the discharged areas, rotates in the counter clockwise direction toward the second gap. A first transfer roller 12, located in contact with a surface of transfer belt 11 opposite the second gap, is biased with a positive voltage to positively charge transfer belt 11 which it contacts. In response to the electric field formed between the surface of the photoconductor drum 7 and transfer belt 11, toner moves from the surface of the photoconductor drum 7 to the surface of the transfer belt 11 as the transfer belt 11 moves in a clockwise direction. First backup roller 14 and second backup roller 15 are also positively biased to assist in the transfer of toner from the transfer belt 11 at a later stage of the printing process. A grooved roller 13 drives the transfer belt 11. This process continues until the transfer belt 11 contains, over its surface, the magenta component of the page which is to be printed. This process is replicated for the cyan 2, the yellow 4, and the black 5 developers. The transfer process from photoconductor drum 7 onto transfer belt 11 is not accomplished with 100% efficiency. Toner remaining on photoconductor drum 7 which does not transfer is removed by cleaning blade 16 and deposited in waste hopper 17.

When all four color planes of the image to be printed have been developed onto photoconductor drum 7 and transferred to transfer belt 11, a second transfer process is used to transfer the developed image present on the surface of transfer belt 11 to print media 19. Transfer belt 11 is located in close proximity to a second transfer roller 18 so that a third gap is formed. Print media 19, which previously has entered the print media path of electrophotographic printing system 1, passes between transfer belt 11 and second transfer roller 18 in this third gap so that the print media 19 contacts the transfer belt 11 and the second transfer roller 18. The second transfer roller positively charges the surface of print media 19 with which it is in contact. As the print media 19 passes between transfer belt 11 and second transfer roller 18, the electric field formed by the positively charged print media 19 pulls toner from the transfer belt 11 onto the print media 19. Subsequent to the transfer of toner from transfer belt 11 to the print media 19, the print media 19 passes through a fuser assembly (not shown) which fixes the toner to the print media 19. The arrival of the leading edge of print media 19 at the third gap is timed so that it corresponds to the top of the printed page on the transfer belt 11.

A high voltage power supply 20 supplies the voltages and currents to the various charge rollers, transfer rollers, and developer rollers, necessary for operation of the electrophotographic processes. High voltage power supply 20 supplies the DC component of the bias voltage and the AC component of the bias voltage to both the photoconductor charge roller 8 and each of the developer rollers in the cyan 2, magenta 3, yellow 4, and black 5 developers in turn as they are used to develop the respective toner colors onto photoconductor drum 7. High voltage power supply 20 includes the capability to adjust the DC component of the bias voltages supplied to photoconductor charge roller 8 and developers 2–5 to optimize the development of toner onto the latent electrostatic image. The transfer rollers are driven with positive DC bias voltage supplied by the high voltage power supply 20 during the transfer operation and a negative DC bias voltage during cleaning cycles.

The photoconductor charge roller 8 is driven with an AC voltage waveform, such as a sinusoid, superimposed upon a negative DC component of the bias voltage. It is possible that the DC bias supplied to photoconductor charge roller 8 is from a voltage source or, alternatively from a current source, in high voltage power supply 20. The amplitude and frequency of the AC voltage waveform are selected so that the surface of photoconductor drum 7 on which charge will be deposited is uniformly charged at approximately the value of the negative DC component of the photoconductor charge roller bias. High voltage power supply 20 has the capability to adjust the negative DC component of the developer bias in order to optimize the development process. The developer rollers 2–5 are driven with a AC voltage waveform, such as a sinusoid or a square wave, having an adjustable negative DC voltage. The DC voltage applied to the developers 2–5 is adjusted to optimize the development of toner onto the latent electrostatic image.

Engine controller 21 provides the necessary control signals at the appropriate times to high voltage power supply 20 to accomplish printing on print media 19 using the electrophotographic processes of electrophotographic printing system 1. In addition, engine controller 21 sends a stream of binary print data to laser scanner 10 to control the pulsing of laser beam 9 for formation of the latent electrostatic image on the surface of photoconductor drum 7. Furthermore, engine controller 21 receives the output from an optical density sensor 23 used for calibration of the electrophotographic printing process. Engine controller 21 generates the control signals to high voltage power supply 20 necessary for controlling the voltages and currents supplied to the charge rollers, transfer rollers, and developer rollers, necessary for operation of the electrophotographic processes. It should be recognized that high voltage power supply 20 could be designed to include the capability of engine controller 21 necessary for controlling the voltages and currents supplied. Engine Formatter 22 receives a print data stream from the host system (not shown) and forms the raster print data stream from this print data stream. The rasterized print data stream is sent to engine controller 21 for conversion to a format suitable for controlling the pulsing of laser beam 9.

To faithfully reproduce images and maintain the desired optical density on the print media, electrophotographic printer 1 employs an optical density sensor 23. Periodically, electrophotographic printer 1 undergoes a calibration cycle in which a correction is made for the various factors which affect the optical density of the toner developed onto the surface of photoconductor drum 7. This calibration is performed for each of the developers 2–5. Factors which affect the amount of toner developed onto the surface of photoconductor drum 7 (thereby affecting the optical density) include such things as changing environmental conditions, wear-out mechanisms affecting photoconductor drum 7 and the developers 2–5, and changes in charging characteristics of the toner. For example, over the operating humidity range of electrophotographic printer 1, both the charge to mass ratio of toner and the effectiveness of photoconductor charge roller 8 in charging photoconductor drum 7 change. Over the operating temperature range, the discharge voltage of the photoconductor drum 7 varies. As the photoconductor drum 7 experiences wear from contact with cleaning blade 16 and from optical fatigue, the discharge voltage of the photoconductor drum 7 changes. Typically, the calibration cycle is performed after the printing of a fixed number of pages. However, it may be performed more frequently or less frequently as circumstances warrant. In addition, a calibration is performed at start up to set the optical density of the developed toner for each of developers 2–5 at the initial desired value.

The calibration process involves the development of areas of varying optical density on photoconductor drum 7 for measurement by optical density sensor 23. In the preferred embodiment, five consecutive areas of different optical density are developed onto the surface of photoconductor drum 7. High voltage power supply 20 is commanded by engine controller 21 to supply five consecutive predetermined values of the DC component of the developer bias to the developers 2–5 as each of them is used for performing the calibration. It should be recognized that the number of pre-determined values of the DC component of the developer bias applied to the one of developers 2–5 used for the calibration may be adjusted depending upon the specific requirements of the electrophotographic system on which the calibration is performed. As well as controlling the operation of high voltage power supply 20, engine controller 21 controls the operation of the previously mentioned components of electrophotographic printer 1 to generate a printed image.

Figure 2:
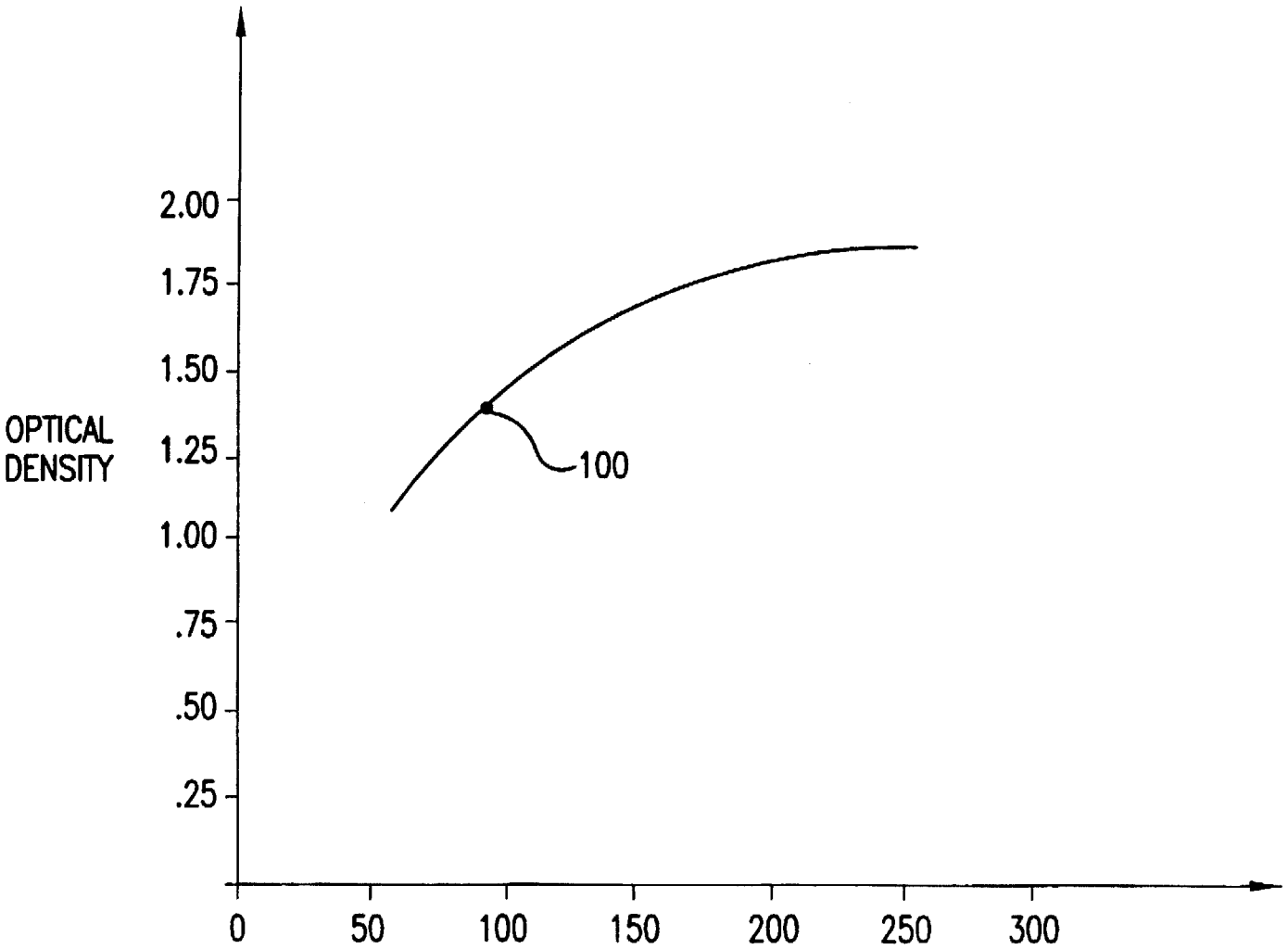
FIG. 2 shows a plot of a typical relationship between optical density and the magnitude of the DC component of the developer bias.

At each of the values of the DC component of the developer bias, toner is developed onto photoconductor drum 7. The optical density of each of these areas developed onto photoconductor drum 7 is measured by optical density sensor 23. Engine controller 21 records the value of the measured optical density and the corresponding value of the DC component of the developer bias. By interpolating from the collected data, engine controller 21 determines the proper DC component of the developer bias required to generate the optimum optical density to ensure high image quality. Shown in FIG. 2 is a graph of a typical relationship expected between the measured optical density on photoconductor drum 7 and the applied DC component of the developer bias. The optimum optical density point 100 is selected so that the DC component of the developer bias applied by high voltage power supply 20 is sufficient to meet the minimum specified optical density for a solid printed area over a wide range of printing conditions. The DC component of the developer bias is adjusted so that the optical density of developed areas is substantially equal to the optical density at the optimum optical density point 100. The term "substantially equal" refers to equality within the measurement tolerances of optical density sensor 23 and the variation in developed optical density which results from variability in the electrophotographic printing processes of electrophotographic printer 1.

Control of the print quality through variation of the DC component of the developer bias using feedback to help maintain consistent optical density results in an improvement in the print quality of the interior regions of toner containing areas on the printed page. However, this optical density control scheme, is not directed at optimizing the development of the edges of toner containing areas on the printed page. Additional controls over the electrophotographic development process will help achieve an improvement in the development of the edges of toner containing areas on the printed page.

Figure 3:
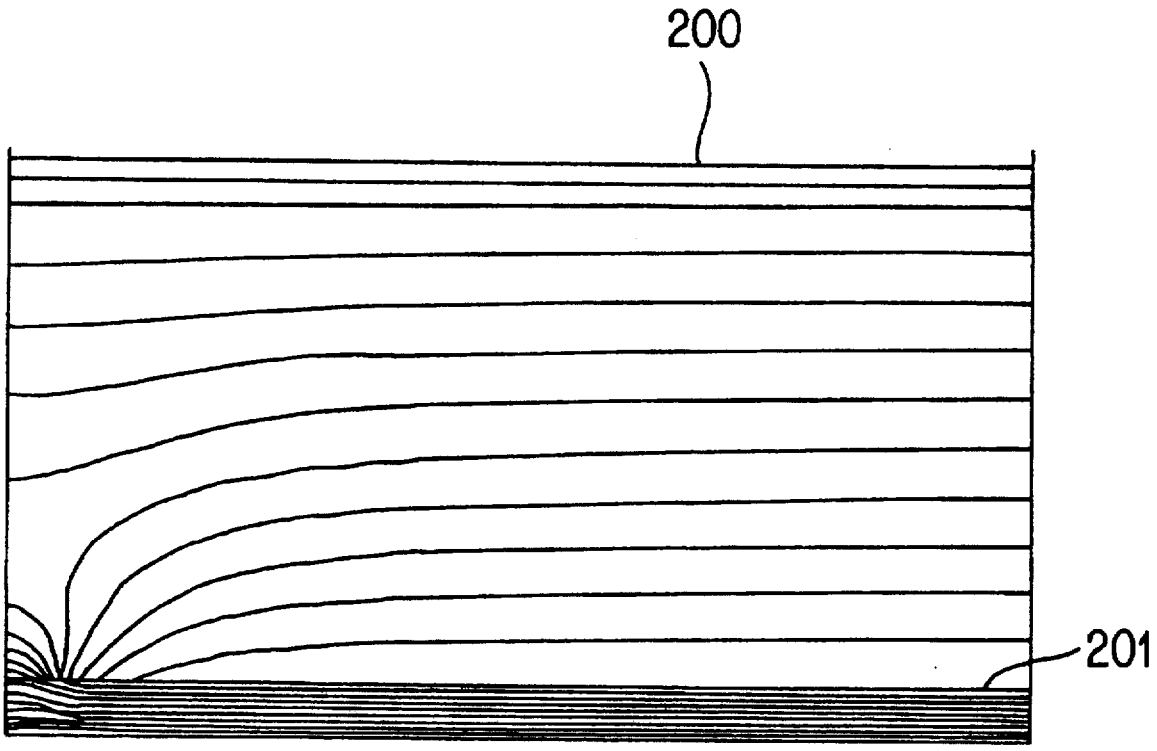
FIG. 3 shows the contour of constant potentials existing between the surface of a photoconductor and the surface of a developer in the vicinity of a relatively small discharged area.

FIG. 3 is a diagram showing contours of constant potential in the first gap between developer roller 6 and the surface of photoconductor drum 7. The contours of constant potential shown in FIG. 3 are illustrated for the case of a small discharge area (relative to a large charged area) on the surface of photoconductor drum 7. This diagram is representative of the potential contours that would result in a similar situation with any of the developers 2–5. The DC component of the potential on the surface of developer roller 6 is represented by contour 200. The potential on the surface of photoconductor drum 7 is represented by contour 201. The printing system schematically represented in FIG. 1 uses negatively charged toner particles, a negatively charged photoconductor drum 7, and negative potentials applied to developer roller 6. In order to prevent background development of toner onto the charged areas of photoconductor drum 7, the DC component of the developer bias applied to developer 6 is set at a lower magnitude than the magnitude of the surface voltage of photoconductor drum 7.

The electric field present in the situation shown in FIG. 3 can be computed as the gradient of the constant potential contours. The dimensions of the discharged area for the situation shown in FIG. 3 are small relative to the width of the first gap between the surface of developer 6 and photoconductor drum 7. Because of the small dimensions of the discharged area relative to the width of the gap, the electric field existing near the surface of the developer 6 is only slightly influenced by the discharged area. As a result, the electrostatic forces exerted on toner present on the surface of developer roller 6 by the electric fields resulting from the discharged area on the surface of photoconductor drum 7 are weak. Stated in a different way, the effects of the electric fields resulting from small sized discharge areas are localized to areas near the surface of photoconductor drum 7. In these areas, the strength of the electric field is primarily influenced by the surface potential of photoconductor drum 7. A similar effect occurs near the edges of relatively large discharged areas on the surface of photoconductor drum 7.

Because of the characteristics of the electric field near the edges of discharged areas, the amount of toner developed onto such areas is influenced by the ratio of the electric field that repels toner from the charged areas on the surface of photoconductor drum 7 to developer roller 6 and the electric field that pushes toner toward the discharged areas of photoconductor drum 7. The electric field that repels toner from the background areas (areas that have not been discharged) on photoconductor drum 7 is proportional to the potential difference between the background areas of photoconductor drum 7 and the DC component of the developer bias. The electric field that pushes toner to the discharged areas on the surface of photoconductor drum 7 is proportional to the DC component of the developer bias.

To demonstrate the factors predominantly controlling the development of toner for different types of discharge patterns, measurements of optical density were made upon solid areas and upon areas formed from a pattern of pixels. A comparison of the measurements of the optical density of solid areas using two different development control techniques indicates the factors that predominately control solid area development. A comparison of the measurements of the optical density of an area having a pixel pattern using these two different development control techniques provides an indication of the factors that predominately control the development of the edges of discharged areas.

Figure 4:
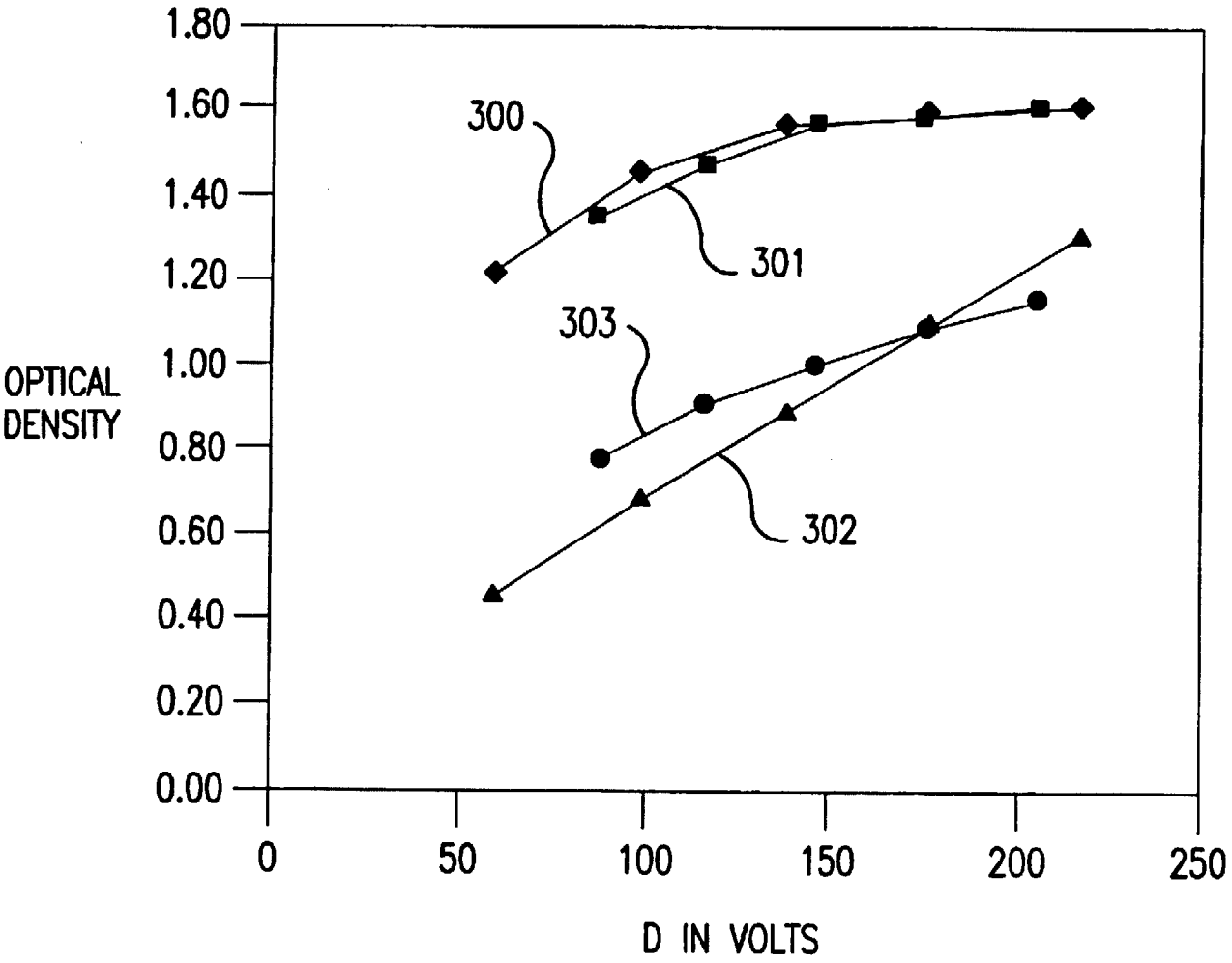
FIG. 4 shows a plot of the optical density versus the magnitude of the DC component of the developer bias for four sets of data generated by printing a solid area and a pattern area using two different development techniques.

Shown in FIG. 4 are graphs of optical density measurements as a function of the DC component of the developer bias. The measurements were made upon a solid area and an area having a pattern for each of two development control techniques to generate the four sets of measurement data shown. The first development control technique consisted of varying the DC component of the developer bias. The second development control technique consisted of varying the DC component of the developer bias and the DC component of the photoconductor charge roller bias so that as the DC component of the developer bias was varied, a difference was maintained between the DC component of the developer bias and the DC component of the photoconductor charge roller bias that was substantially equal to a constant value. The term "substantially equal" to a constant value or "substantially constant" as used in this specification means that the difference between the DC component of the developer bias and the DC component of the photoconductor charge roller bias only changes within the range of variability of the outputs of high voltage power supply 20. It should be recognized that although the operation of the development system is described for electrophotographic printer 1 using a photoconductor charge roller, it should be recognized that the develop system could operate with other types of photoconductor charging devices, such as a scorotron.

Consider first 300 and second 301 set of data shown in FIG. 4. First set of data 300 includes solid area optical density measurements with the DC component of the photoconductor charge roller bias held constant while varying the DC component of the developer bias. This corresponds to the first development control technique. The second set of data 301 includes solid area optical density measurements with the difference between the DC component of the developer bias and the DC component of the photoconductor charge roller bias held constant as the DC component of the developer bias is varied. This corresponds to the second development control technique. The graphs of first 300 and second 301 sets of data in FIG. 4 are plotted as a function of the magnitude of the DC component of the developer bias. As can be seen from the close agreement of the measurement data for the two development control techniques applied to the solid area development, the development of the solid area is predominantly controlled by the magnitude of DC component of the developer bias. Stated another way, for the development of solid areas the second development control technique does not appear to provide a substantial improvement in the performance of the development system.

Consider third 302 and fourth 303 sets of data shown in FIG. 4. Third set of data 302 includes the data from optical density measurements performed upon an area having a pattern developed using the first development control technique. Fourth set of data 303 includes data from optical density measurements performed upon an area having a pattern developed using the second development control technique. The graphs of the third 302 and the fourth 303 set of data in FIG. 4 are plotted as a function of the DC component of the developer bias. As can be seen from these plots, there is not close agreement between the measurement data for the two development control techniques applied to the pattern area development. This indicates that the DC component of the developer bias is not the only factor affecting the optical density of the pattern area. Furthermore, the divergence between the graphs of the third 302 and the fourth 303 set of data indicate that there is a difference in the performance of the development system.

Figure 5:
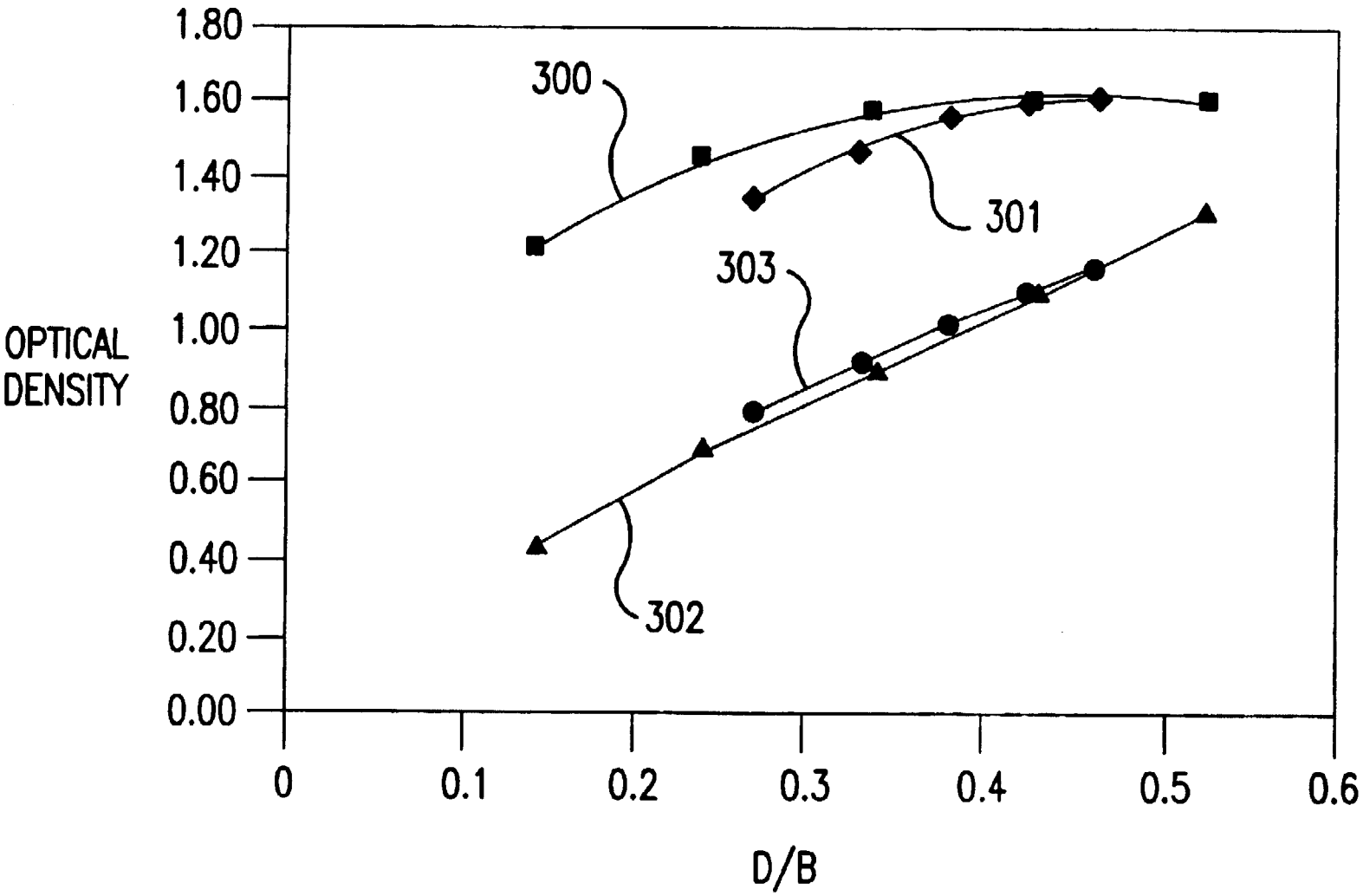
FIG. 5 shows a plot of the optical density versus D/B using the same four sets of data plotted in FIG. 4.

Shown in FIG. 5 are graphs of the same data used to generate the graphs in FIG. 4 plotted as a function of the ratio of the magnitude of the DC component of the developer bias to the magnitude of the difference between the DC component of the developer bias and the DC component of the photoconductor charge roller bias. When plotted as in FIG. 4, the graphs of the first 300 and the second 301 set of data show that the optical density of the solid areas is not predominantly determined by the ratio of the magnitude of the DC component of the developer bias to the magnitude of the difference between the DC component of the developer bias and the DC component of the photoconductor charge roller bias. However, the graphs of the third 302 and the fourth 303 set of data indicate that there is close correlation between the optical density of the pattern areas using the first and the second development control techniques when the data is plotted as a function of the previously mentioned ratio. The development of a pattern area includes a large amount of edge development relative to the solid area development. The correlation of the third 302 and the fourth 303 set of data in FIG. 5 indicates that the pattern area development is predominantly a function of the ratio of the magnitude of the DC component of the developer bias to the magnitude of the difference between the DC component of the developer bias and the DC component of the photoconductor charge roller bias.

Based upon the measurement data a mathematical relationship approximating the mass per unit area developed in a solid area development is given as:

$$|M/A|=a\times D+b$$

In this relationship, "D" represents the magnitude of the DC component of the developer bias and "a" and "b" are constants. The relationship approximating the mass per unit area of patterns which contain a relatively large proportion of edge length is given as:

$$|M/A|=c\times D/B+d$$

In this relationship, "D" represents the magnitude of the DC component of the developer bias, "B" represents the magnitude of the difference between the DC component of the developer bias and the DC component of the photoconductor charge roller bias, and "c" and "d" are constants.

In the preferred embodiment of the development system, the value of B is held constant as the value of D is adjusted. The value of B is held constant by adjusting the DC component of the photoconductor charge roller bias to track the change in the DC component of the developer bias. The result of implementing the development system in this manner is that the developed mass per unit area of solid areas and the developed mass per unit area of patterns are each controlled as a function of D.

The value of D is adjusted during the calibration process to ensure that the optical density of solid areas is substantially equal to the optimum optical density point 100. The development system responds to the adjustment in the value of D by changing the DC component of the photoconductor charge roller bias so that the value of B is constant. By maintaining B at a constant value, there is a closer correlation between the optical densities of solid areas and pattern areas.

Figure 6:
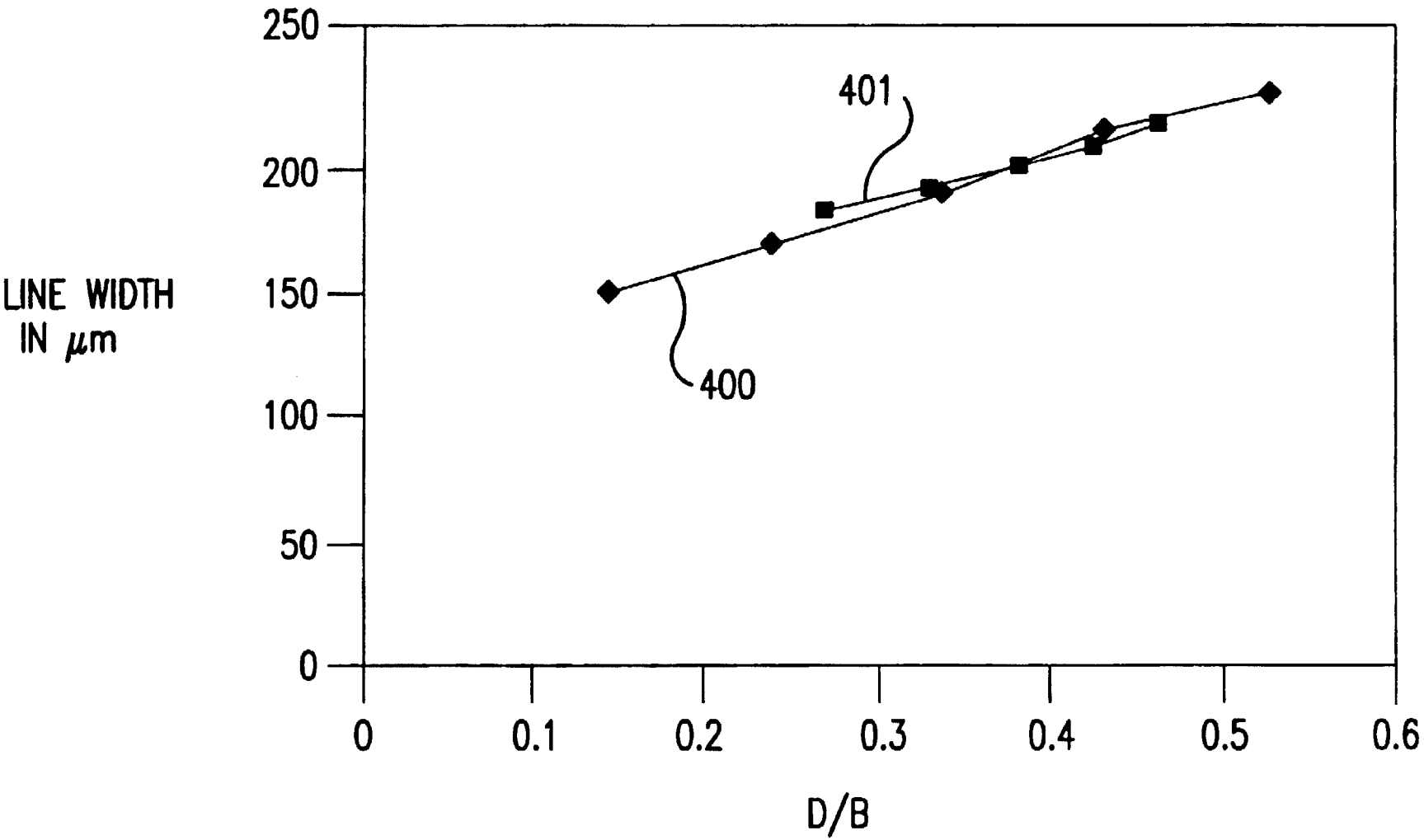
FIG. 6 shows a plot of two sets of line width data versus D/B using two different development techniques.

Shown in FIG. 6 is a graph of measured line widths in microns versus the ratio of the magnitude of the DC component of the developer bias to the magnitude of the difference between the DC component of the developer bias and the DC component of the photoconductor charge roller bias. The lines upon which the measurements were made are 4 dot wide lines. Fifth set of data 400 was generated for the condition in which the DC component of the photoconductor charge roller bias was held constant. Sixth set of data 401 was generated for the condition in which the value of B was held constant as the DC component of the developer bias was varied. The plots of the fifth set of data 400 and the sixth set of data 401 are closely correlated. This close correlation indicates that the performance of the first and the second development control techniques, with respect to line widths, are both predominantly a function of the D/B ratio.

Figure 7:
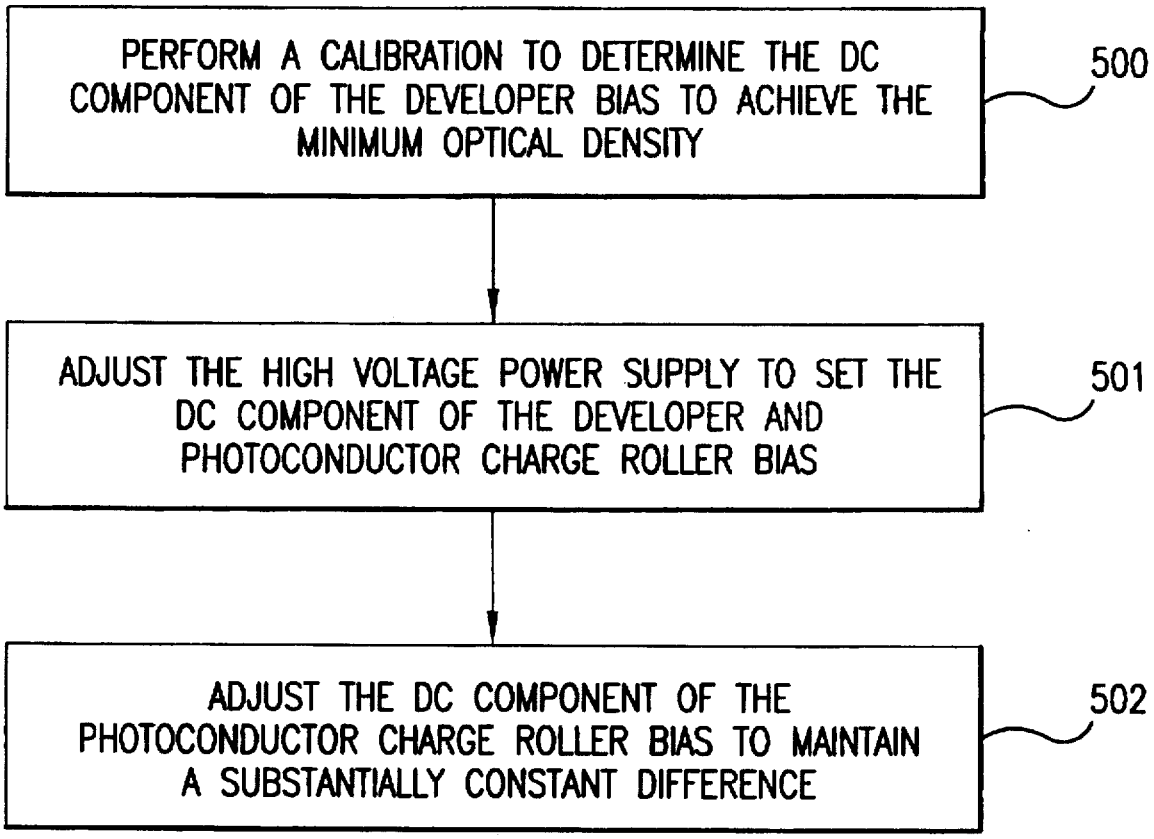
FIG. 7 shows a flow chart of a method for improving edge development using the preferred embodiment of the development system.

Shown in FIG. 7 is a method for using the development system of FIG. 1 to achieve improvement in the development of edges. The first step 500 includes the calibration of the electrophotographic printing system of FIG. 1 to determine the value of the DC component of the developer bias required to meet the optical density requirements of solid areas. The second step 501 includes controlling high voltage power supply 20 to set the DC component of the photoconductor charge roller bias so that the desired line width is achieved while setting the value of the DC component of the developer bias at the value selected in first step 500. Finally, for subsequent calibration operations, the third step 502 includes controlling the DC component of the photoconductor charge roller so that the difference between the value of the DC component of the developer bias and the photoconductor charge roller bias remains substantially constant.

Although several embodiments of the invention have been illustrated, and their forms described, it is readily apparent to those of ordinary skill in the art that various modifications may be made therein without departing from the spirit of the invention or from the scope of the appended claims.

What is claimed is:

1. A development system for developing toner onto a photoconductor comprising:

a developing device to develop toner onto the photoconductor;

a photoconductor charging device to charge the photoconductor;

a power supply coupled to the developing device and the photoconductor charging device with the power supply for supplying a first DC bias to the developing device and supplying a second DC bias to the photoconductor charging device with the difference in the magnitude of the first DC bias and the second DC bias remaining substantially constant with changes in the first DC bias;

a controller coupled to the power supply to control the first DC bias and the second DC bias: and an optical density sensor located adjacent to the photoconductor and coupled to the controller, with the optical density sensor for providing a signal used to control the first DC bias.

2. The development system as recited in claim 1, wherein:

the photoconductor charging device includes a charge roller.

3. The development system as recited in claim 2, wherein:

the developing device includes a developing roller.

4. The development system as recited in claim 3, wherein:

the photoconductor includes a photoconductor drum.

5. An electrophotographic printing system, comprising:

a photoconductor;

a photoconductor charging device to charge the photoconductor;

a developing device to develop toner onto the photoconductor;

a power supply coupled to the developing device and the photoconductor charging device with the power supply for supplying a first DC bias to the developing device and supplying a second DC bias to the photoconductor charging device with the difference in the magnitude of the first DC bias and the second DC bias remaining substantially constant with changes in the first DC bias;

a controller coupled to the power supply to control the first DC bias and the second DC bias; and an optical density sensor located adjacent to the photoconductor and coupled to the controller, with the optical density sensor for providing a signal used to control the first DC bias.

6. The electrophotographic printing system as recited in claim 5, wherein:

the electrophotographic printing system includes a color electrophotographic printer.

7. The electrophotographic printing system as recited in claim 6, wherein:

the photoconductor charging device includes a charge roller.

8. The electrophotographic printing system as recited in claim 7, wherein:

the developing device includes a developing roller.

9. The electrophotographic printing system as recited in claim 8, wherein:

the photoconductor includes a photoconductor drum.

10. In an electrophotographic printing system having a photoconductor, a photoconductor charging device to charge the photoconductor, a developing device, a power supply to provide a first DC bias to the developing device and a second DC bias to the photoconductor charging device, a controller to control the first DC bias and the second DC bias, and an optical density sensor located adjacent to the photoconductor and coupled to the controller, a method for controlling the development of toner onto the photoconductor comprising the steps of:

setting the first DC bias at a first value;

setting the second DC bias at a second value;

developing the toner onto the photoconductor using the developing device;

measuring the optical density of the toner developed onto the photoconductor using the optical density sensor;

adjusting the first DC bias based upon the step of measuring; and maintaining the difference in the magnitude of the first DC bias and the second DC bias substantially equal to a first predetermined value after the step of adjusting.

11. The method as recited in claim 10, wherein:

the step of adjusting the first DC bias includes adjusting the first DC bias to maintain the optical density from the step of measuring substantially equal to a second predetermined value.

12. The method as recited in claim 11, further comprising the step of:

performing a first calibration using the controller, the power supply, and the optical density sensor to determine the first value of the first DC bias required to maintain the optical density substantially equal to the second predetermined value with the step of performing the first calibration occurring prior to the step of setting the first DC bias.

13. The method as recited in claim 12, further comprising the steps of:

performing successive calibrations using the controller, the power supply, and the optical density sensor to determine successive values of the first DC bias required to maintain the optical density substantially equal to the second predetermined value; and successively setting the first DC bias at each of the successive values of the first DC bias determined after performing each of the corresponding of the successive calibrations.

14. The method as recited in claim 13, further comprising the step of:

successively setting the second DC bias after each of the successive calibrations to maintain the difference between the corresponding successive values of the first DC bias and the second DC bias substantially equal to the first predetermined value.

* * * * *